US006488814B2

(12) United States Patent
Scherb et al.

(10) Patent No.: US 6,488,814 B2
(45) Date of Patent: Dec. 3, 2002

(54) PRESSING ARRANGEMENT

(75) Inventors: Thomas Thoröe Scherb, Sao Paulo (BR); Harald Schmidt-Hebbel, Barueri (BR)

(73) Assignee: Voith Paper Patent GmbH, Heidenheim (DE)

( * ) Notice: Subject to any disclaimer, the term of this patent is extended or adjusted under 35 U.S.C. 154(b) by 45 days.

(21) Appl. No.: 09/741,886

(22) Filed: Dec. 22, 2000

(65) Prior Publication Data

US 2001/0035103 A1 Nov. 1, 2001

(30) Foreign Application Priority Data

Dec. 23, 1999 (DE) ..... 199 62 708

(51) Int. Cl.[7] ..... D21F 3/00
(52) U.S. Cl. ..... 162/205; 162/358.3
(58) Field of Search ..... 100/38, 76, 327, 100/334, 155 R, 156; 162/109, 111, 117, 122, 205, 206, 358.1, 358.2, 358.3, 358.4, 358.5, 359.1, 360.2, 360.3, 361, 305

(56) References Cited

U.S. PATENT DOCUMENTS

| | | | | |
|---|---|---|---|---|
| 4,889,674 A | * | 12/1989 | Krenkel et al. | 264/130 |
| 4,915,790 A | * | 4/1990 | Dahl | 162/305 |
| 5,062,924 A | * | 11/1991 | McCarten et al. | 162/358.4 |
| 5,556,511 A | * | 9/1996 | Bluhm et al. | 162/206 |
| 5,681,431 A | * | 10/1997 | Steiner | 162/360.2 |
| 5,690,791 A | * | 11/1997 | Vallius | 162/205 |
| 5,849,156 A | | 12/1998 | Vallius | 162/205 |
| 5,908,536 A | * | 6/1999 | Kaasalainen et al. | 162/205 |
| 6,004,429 A | | 12/1999 | Schiel | |
| 6,248,210 B1 | * | 6/2001 | Edwards et al. | 162/111 |
| 6,309,512 B1 | | 10/2001 | Bengtsson et al. | 162/358.5 |

FOREIGN PATENT DOCUMENTS

| | | |
|---|---|---|
| DE | 4020589 | 1/1992 |
| DE | 29506352 | 7/1995 |
| DE | 19654198 | 6/1998 |
| EP | 1016754 | 7/2000 |
| WO | 00/17445 | 3/2000 |
| WO | 00/29667 | 5/2000 |

OTHER PUBLICATIONS

Leffler "Through–Air Drying technology for absorbent, soft and high bulk tissue," Paper Technology (Sep. 1998).

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

Pressing arrangement of a machine and process for producing a web. The pressing arrangement includes a shoe press unit and an opposing roll arranged to form at least one press nip. The shoe press unit includes at least one press shoe arranged opposite the opposing roll and a flexible, liquid-impermeable press belt arranged to be guided over the press shoe. The opposing roll includes a smooth surface. At least one press felt is arranged to be guided through the press nip along with the press belt and the web. The at least one felt is deflected away from the web, which is picked up by the smooth surface of the opposing roll, such that the at least one felt is guided out of the press nip at an angle greater than or equal to about 10° to a tangent to the opposing roll at an end of the press nip.

28 Claims, 2 Drawing Sheets

PRESSING ARRANGEMENT

CROSS-REFERENCE TO RELATED APPLICATIONS

The present application claims priority under 35 U.S.C. §119 of German Patent Application No. 199 62 708.8, filed on Dec. 23, 1999, the disclosure of which is expressly incorporated by reference herein in its entirety.

BACKGROUND OF THE INVENTION

1. Field of the Invention

The invention relates to a pressing arrangement of a machine for producing a tissue web, having at least one press nip formed between a shoe press unit and an opposing roll, where the shoe press unit includes at least one press shoe lying across from the opposing roll and a flexible, watertight press belt, the opposing roll has a smooth surface, and the tissue web is guided through the press nip along with the press belt and at least one felt and is subsequently removed from the felt and picked up by the smooth surface of the opposing roll. Such a pressing arrangement can be one part of or essentially form the entirety of the pressing arrangement of the tissue machine in question.

2. Discussion of Background Information

In a pressing arrangement of the type mentioned at the outset known from DE 196 54 198 A1 having a drying cylinder forming the opposing roll, the tissue web travels out of the press nip in an approximately tangential direction relative to the surface of the drying cylinder.

SUMMARY OF THE INVENTION

The present invention provides a pressing arrangement of the type mentioned at the outset with which a higher dry content of the tissue web leaving the press nip can be achieved and with which a more economic production of tissue is guaranteed.

According to the invention, an angle between the tangent positioned against the opposing roll at the end of the press nip and at least one felt leaving the press nip is greater than or equal to about 10°, in particular greater than or equal to about 15°, in particular greater than or equal to about 18°, and preferably greater than or equal to about 20°.

Due to this construction, a higher dry content of the tissue web after the press is achieved.

In particular, a shoe press roll having a press jacket forming the press belt, can be provided as a shoe press unit.

Preferably, a drying cylinder and, in particular, a so-called Yankee cylinder, is provided as an opposing roll.

The surface of the press belt can be blind-bored and/or grooved.

More advantageously, the press belt has an open surface "f" of f greater than or equal to about 25%.

For an open surface of, e.g., f=36%, of a grooved press belt and/or press jacket at an exit angle of the felt of $\alpha$=20°, a 4.5% increase in the dry content can be achieved as compared to the dry content achieved using a conventional suction press roll instead of a shoe press roll.

The pressing arrangement according to the invention may be advantageously used in tissue machines such as, in particular, a suction breast roll former, twin wire former, crescent former, fourdrinier wire former, and/or the like and/or in combination with "through air drying" concepts.

The present invention is directed to a pressing arrangement of a machine for producing a web. The pressing arrangement includes a shoe press unit and an opposing roll arranged to form at least one press nip. The shoe press unit includes at least one press shoe arranged opposite the opposing roll and a flexible, liquid-impermeable press belt arranged to be guided over the press shoe. The opposing roll includes a smooth surface. At least one press felt is arranged to be guided through the press nip along with the press belt and the web. The at least one felt is subsequently separated from the web, which is picked up by the smooth surface of the opposing roll, such that the at least one felt is guided out of the press nip at an angle greater than or equal to about 10° to a tangent to the opposing roll at an end of the press nip.

In accordance with a feature of the invention, the at least one press felt can be guided at an angle of greater than or equal to about 15° to the tangent to the opposing roll at the end of the press nip. Further, the at least one press felt may be guided at an angle of greater than or equal to about 18° to the tangent to the opposing roll at the end of the press nip, and preferably, the at least one press felt can be guided at an angle of preferably greater than or equal to about 20° to the tangent to the opposing roll at the end of the press nip.

According to another feature of the invention, the web can include a tissue web.

In accordance with still another feature of the present invention, the press unit may include a shoe press roll with a press jacket, and the press jacket can form the press belt.

The opposing roll may include a drying cylinder, and the drying cylinder can include a Yankee roll.

Further, a surface of the press belt may include at least one of blind-bores and grooves. The at least one of the blind-bores and grooves can be arranged such that the surface is greater than or equal to 25% open.

According to a further feature of the instant application, the surface of the press belt may have an open surface of greater than or equal to about 25%.

Moreover, the machine for producing a web can include a tissue machine. Still further, the machine for producing a web can include a suction breast roll former of the tissue machine. Alternatively, the machine for producing a web may include a twin wire former of the tissue machine. The machine for producing a web can also include a crescent former of the tissue machine, or a fourdrinier former of the tissue machine. Also, the pressing arrangement can be utilized in combination with a through air drying device.

According to another feature of the invention, a thin fabric may be arranged between the at least one press felt and the web. The thin fabric can be one of a dewatering wire and an imprinting wire. Further, the thin fabric may have a thickness less than about 2 mm, and advantageously less than about 1 mm.

The present invention is directed to a process for producing a web in an apparatus that includes a shoe press unit and an opposing roll arranged to form at least one press nip, where the shoe press unit includes at least one press shoe arranged opposite the opposing roll and a flexible, liquid-impermeable press belt arranged to be guided over the press shoe and the opposing roll includes a smooth surface, and at least one press felt. The process may include guiding the web, the at least one press felt and the press belt through the at least one press nip, and guiding the at least one press felt from an exit of the press nip an angle greater than or equal to about 10° to a tangent to the opposing roll at the exit of the press nip. In this manner, the at least one press felt is separated from the web, which is picked up by the opposing roll.

In accordance with a feature of the present invention, the at least one press felt may be guided from the press nip exit at an angle greater than or equal to about 15° to the tangent to the opposing roll at the press nip exit. Further, the at least one press felt can be guided from the press nip exit at an angle greater than or equal to about 18° to the tangent to the opposing roll at the press nip exit, and preferably, the at least one press felt may be guided from the press nip exit at an angle greater than or equal to about 20° to the tangent to the opposing roll at the press nip exit.

According to still another feature of the invention, the drying cylinder can include a Yankee roll, and the process may further include heating the web in the at least one press nip.

In accordance with yet another feature of the instant invention, a surface of the press belt may have an open surface of greater than or equal to about 25%, and the process can further include carrying away water with the press belt.

In accordance with still yet another feature of the present invention, the apparatus further includes a thin fabric arranged between the web and the felt, and the process can further include deflecting the thin fabric away from the web at an angle less than or equal to the angle of the felt.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of a non-limiting example of an exemplary embodiment of the present invention, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
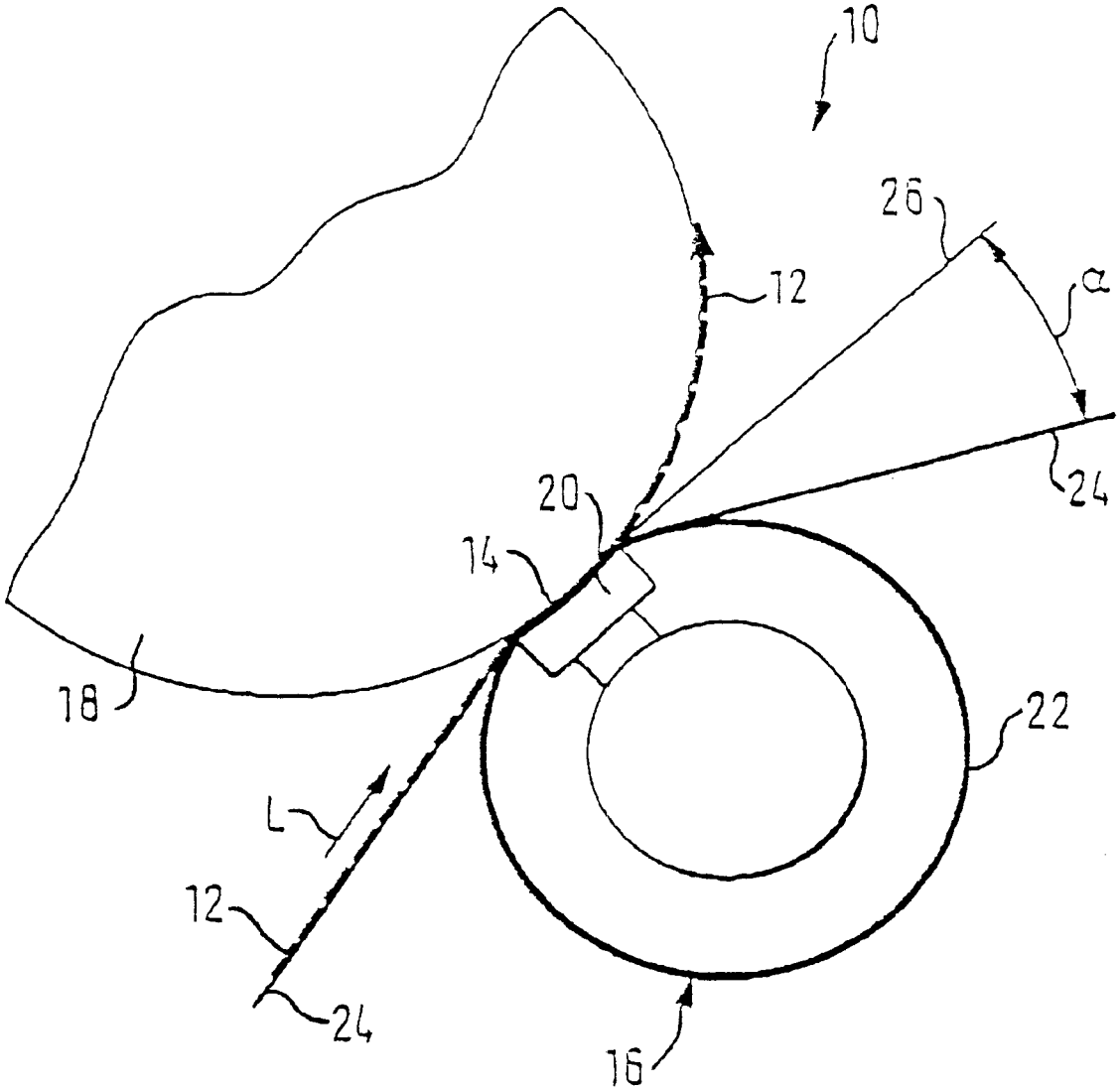
FIG. 1 schematically illustrates a partial view of a pressing arrangement of a machine for producing a tissue web.

FIG. 1 illustrates a schematic partial view of a pressing arrangement 10 of a machine for producing a tissue web 12.

The pressing arrangement 10 includes a press nip 14 elongated in the web travel direction L that is formed between a shoe press unit provided as a shoe press roll 16 and an opposing roll provided as a drying cylinder 18, for example, a Yankee cylinder.

The shoe press roll 16 includes a press shoe 20 lying across from the drying cylinder 18 and a press jacket 22 guided over the press shoe embodied by a flexible, liquid-impermeable press belt.

The tissue web 12 is guided through the press nip 14 along with the press jacket 22 and a felt 24. After the press nip 14, the tissue web 12 is separated from the felt 24 and picked up by the smooth surface of the drying cylinder 18.

The angle $\alpha$ between the tangents 26 positioned against the drying cylinder 18 at the end of the press nip 14 and the felt 24 exiting from the press nip 14 is greater than or equal to about 20°.

The surface of the press jacket can be bored or grooved.

The press jacket 22 can, in particular, have an open area "f" of f greater than or equal to about 25%.

Figure 2:
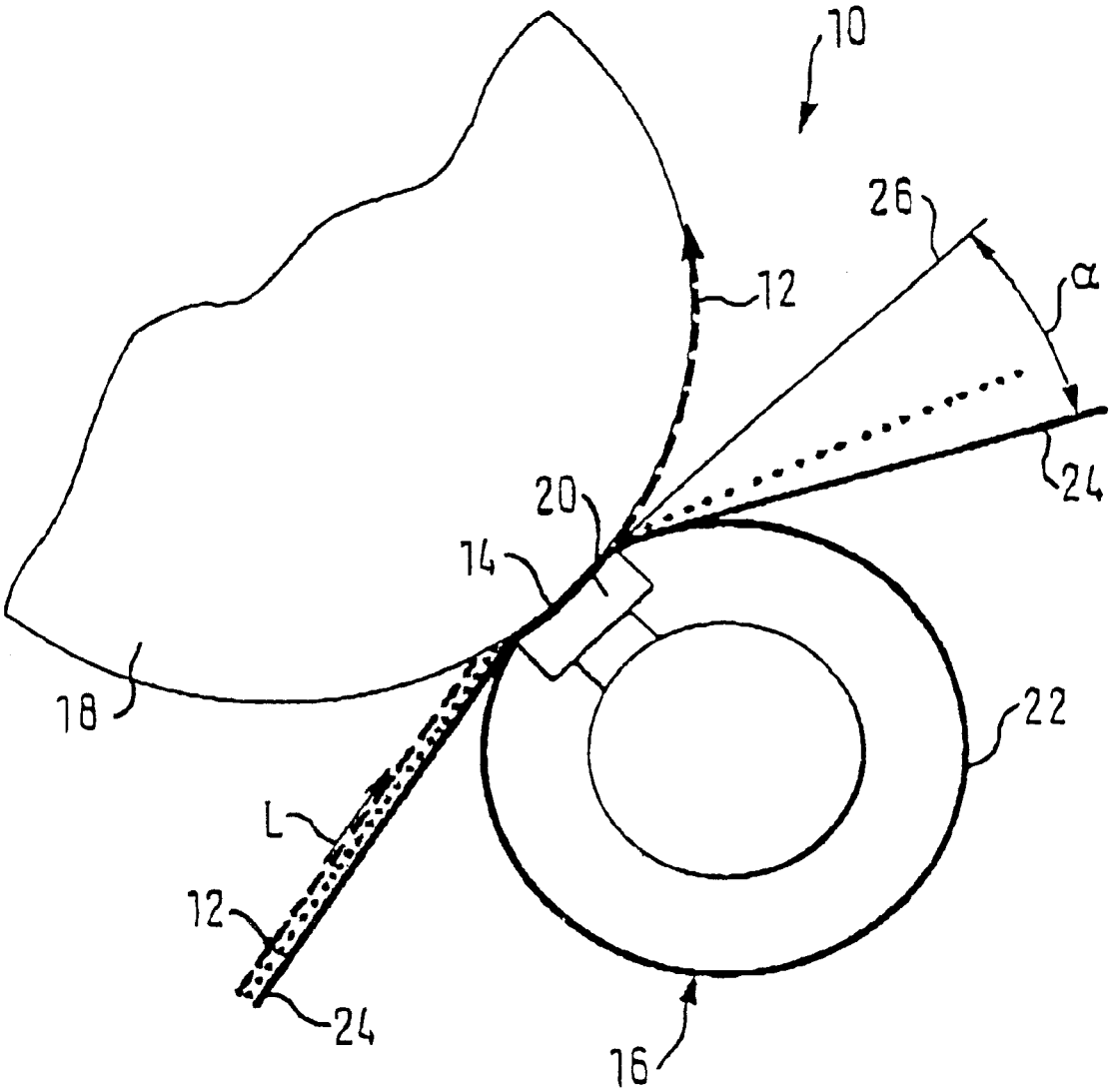
FIG. 2 schematically illustrates a partial view of an alternative pressing arrangement of a machine for producing a tissue web.

In a further embodiment of the invention, as illustrated in FIG. 2, a thin fabric F, e.g., less than 2 mm thick and advantageously less than 1 mm thick, can optionally be positioned between web 12 and felt 24.

According to the invention, thin fabric F is preferably air and water permeable, and can be formed as, e.g., a dewatering wire. As an alternative, thin fabric F may be formed, e.g., as an imprinting wire, which is arranged to create a structure in the web surface.

It is noted that thin fabric F can be guided out of press nip 14 at a same angle as, or at a smaller angle than, felt 24.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Pressing arrangement
12 Tissue web
14 Press nip
16 Shoe press roll
18 Drying cylinder
20 Press shoe
22 Press jacket
24 Felt
26 Tangents
F Thin fabric
L Web travel direction

What is claimed:

1. A pressing arrangement of a machine for producing a web comprising:

a shoe press unit and an opposing roll arranged to form at least one press nip;

said shoe press unit comprising at least one press shoe arranged opposite the opposing roll and a flexible, liquid-impermeable press belt arranged to be guided over said press shoe, wherein a surface of said press belt comprises at least one of blind-bores and grooves;

said opposing roll comprising a smooth surface, at least one press felt arranged to be guided through said press nip along with said press belt and the web, wherein said at least one felt is deflected away from the web, which is picked up by said smooth surface of said opposing roll, such that said at least one felt is guided out of said press nip at an angle to a tangent to said opposing roll at an end of said press nip that is greater than or equal to about 10°.

2. The pressing arrangement in accordance with claim 1, wherein said at least one press felt is guided at an angle of greater than or equal to about 15° to the tangent to said opposing roll at the end of said press nip.

3. The pressing arrangement in accordance with claim 1, wherein said at least one press felt is guided at an angle of greater than or equal to about 18° to the tangent to said opposing roll at the end of said press nip.

4. The pressing arrangement in accordance with claim 1, wherein said at least one press felt is guided at an angle of preferably greater than or equal to about 20° to the tangent to said opposing roll at the end of said press nip.

5. The pressing arrangement in accordance with claim 1, wherein said press unit comprises a shoe press roll with a press jacket, and wherein said press jacket forms said press belt.

6. The pressing arrangement in accordance with claim 1, wherein said at least one of said blind-bores and grooves are arranged such that said surface is greater than or equal to 25% open.

7. A pressing arrangement of a machine for producing a web comprising:

a shoe press unit and an opposing roll arranged to form at least one press nip;

said shoe press unit comprising at least one press shoe arranged opposite the opposing roll and a flexible, liquid-impermeable press belt arranged to be guided over said press shoe;

said opposing roll comprising a smooth surface, at least one press felt arranged to be guided through said press nip along with said press belt and the web, wherein said at least one felt is deflected away from the web, which is picked up by said smooth surface of said opposing roll, such that said at least one felt is guided out of said press nip at an angle to a tangent to said opposing roll at an end of said press nip that is greater than or equal to about 10°, wherein the web comprises a tissue web.

8. A pressing arrangement of a machine for producing a web comprising:

a shoe press unit and an opposing roll arranged to form at least one press nip;

said shoe press unit comprising at least one press shoe arranged opposite the opposing roll and a flexible, liquid-impermeable press belt arranged to be guided over said press shoe;

said opposing roll comprising a smooth surface, at least one press felt arranged to be guided through said press nip along with said press belt and the web, wherein said at least one felt is deflected away from the web, which is picked up by said smooth surface of said opposing roll, such that said at least one felt is guided out of said press nip at an angle to a tangent to said opposing roll at an end of said press nip that is greater than or equal to about 10°, wherein said opposing roll comprises a drying cylinder.

9. The pressing arrangement in accordance with claim 8, wherein said drying cylinder comprises a Yankee roll.

10. The pressing arrangement in accordance with claim 8, wherein a surface of said press belt comprises at least one of blind-bores and grooves.

11. A pressing arrangement of a machine for producing a web comprising:

a shoe press unit and an opposing roll arranged to form at least one press nip;

said shoe press unit comprising at least one press shoe arranged opposite the opposing roll and a flexible, liquid-impermeable press belt arranged to be guided over said press shoe;

said opposing roll comprising a smooth surface, at least one press felt arranged to be guided through said press nip along with said press belt and the web, wherein said at least one felt is deflected away from the web, which is picked up by said smooth surface of said opposing roll, such that said at least one felt is guided out of said press nip at an angle to a tangent to said opposing roll at an end of said press nip that is greater than or equal to about 10°, wherein said surface of said press belt has an open surface of greater than or equal to about 25%.

12. A pressing arrangement of a machine for producing a web comprising:

a shoe press unit and an opposing roll arranged to form at least one press nip;

said shoe press unit comprising at least one press shoe arranged opposite the opposing roll and a flexible, liquid-impermeable press belt arranged to be guided over said press shoe;

said opposing roll comprising a smooth surface, at least one press felt arranged to be guided through said press nip along with said press belt and the web, wherein said at least one felt is deflected away from the web, which is picked up by said smooth surface of said opposing roll, such that said at least one felt is guided out of said press nip at an angle to a tangent to said opposing roll at an end of said press nip that is greater than or equal to about 10°, wherein the machine for producing a web comprises a tissue machine.

13. The pressing arrangement in accordance with claim 12, wherein the machine for producing a web comprises a suction breast roll former of the tissue machine.

14. The pressing arrangement in accordance with claim 12, wherein the machine for producing a web comprises a twin wire former of the tissue machine.

15. The pressing arrangement in accordance with claim 12, wherein the machine for producing a web comprises a crescent former of the tissue machine.

16. The pressing arrangement in accordance with claim 12, wherein the machine for producing the web comprises a fourdrinier former of the tissue machine.

17. The pressing arrangement in accordance with claim 12, in combination with a through air drying device.

18. A pressing arrangement of a machine for producing a web comprising:

a shoe press unit and an opposing roll arranged to form at least one press nip;

said shoe press unit comprising at least one press shoe arranged opposite the opposing roll and a flexible, liquid-impermeable press belt arranged to be guided over said press shoe;

said opposing roll comprising a smooth surface, at least one press felt arranged to be guided through said press nip along with said press belt and the web, wherein said at least one felt is deflected away from the web, which is picked up by said smooth surface of said opposing roll, such that said at least one felt is guided out of said press nip at an angle to a tangent to said opposing roll at an end of said press nip that is greater than or equal to about 10°; and a thin fabric arranged between said at least one press felt and the web.

19. The pressing arrangement in accordance with claim 18, wherein said thin fabric is one of a dewatering wire and an imprinting wire.

20. The pressing arrangement in accordance with claim 18, wherein said thin fabric has a thickness less than about 2 mm.

21. The pressing arrangement in accordance with claim 18, wherein said thin fabric has a thickness less than about 1 mm.

22. A process for producing a web in an apparatus that includes a shoe press unit and an opposing roll arranged to form at least one press nip, where the shoe press unit includes at least one press shoe arranged opposite the opposing roll and a flexible, liquid-impermeable press belt, comprising a surface with at least one of grooves and blind bores, arranged to be guided over the press shoe and the opposing roll includes a smooth surface, and at least one press felt, said process comprising:

guiding the web, the at least one press felt and the press belt through the at least one press nip; and guiding the at least one press felt from an exit of the press nip at an angle greater than or equal to about 10° to a tangent to the opposing roll at the exit of the press nip, whereby the at least one press felt is deflected away from the web, which is picked up by the opposing roll; and carrying water away from the web in the at least one of grooves and blind bores.

23. The process in accordance with claim 22, wherein the at least one press felt is guided from the press nip exit at an angle greater than or equal to about 15° to the tangent to the opposing roll at the press nip exit.

24. The process in accordance with claim 22, wherein the at least one press felt is guided from the press nip exit at an angle greater than or equal to about 18° to the tangent to the opposing roll at the press nip exit.

25. The process in accordance with claim 22, wherein the at least one press felt is guided from the press nip exit at an angle greater than or equal to about 20° to the tangent to the opposing roll at the press nip exit.

26. A process for producing a web in an apparatus that includes a shoe press unit and an opposing roll arranged to form at least one press nip, where the shoe press unit includes at least one press shoe arranged opposite the opposing roll and a flexible, liquid-impermeable press belt arranged to be guided over the press shoe and the opposing roll includes a smooth surface, and at least one press felt, said process comprising:

guiding the web, the at least one press felt and the press belt through the at least one press nip; and guiding the at least one press felt from an exit of the press nip at an angle greater than or equal to about 10° to a tangent to the opposing roll at the exit of the press nip, whereby the at least one press felt is deflected away from the web, which is picked up by the opposing roll, wherein the drying cylinder comprises a Yankee roll, and the process further comprises heating the web in the at least one press nip.

27. A process for producing a web in an apparatus that includes a shoe press unit and an opposing roll arranged to form at least one press nip, where the shoe press unit includes at least one press shoe arranged opposite the opposing roll and a flexible, liquid-impermeable press belt arranged to be guided over the press shoe and the opposing roll includes a smooth surface, and at least one press felt, said process comprising:

guiding the web, the at least one press felt and the press belt through the at least one press nip; and guiding the at least one press felt from an exit of the press nip at an angle greater than or equal to about 10° to a tangent to the opposing roll at the exit of the press nip, whereby the at least one press felt is deflected away from the web, which is picked up by the opposing roll, wherein a surface of the press belt has an open surface of greater than or equal to about 25%, and the process further comprises carrying away water with the press belt.

28. A process for producing a web in an apparatus that includes a shoe press unit and an opposing roll arranged to form at least one press nip, where the shoe press unit includes at least one press shoe arranged opposite the opposing roll and a flexible, liquid-impermeable press belt arranged to be guided over the press shoe and the opposing roll includes a smooth surface, at least one press felt, and a thin fabric arranged between the web and the felt, said process comprising:

guiding the web, the at least one press felt and the press belt through the at least one press nip;

guiding the at least one press felt from an exit of the press nip at an angle greater than or equal to about 10° to a tangent to the opposing roll at the exit of the press nip, whereby the at least one press felt is deflected away from the web, which is picked up by the opposing roll; and deflecting the thin fabric away from the web at an angle less than or equal to the angle of the felt.

* * * * *